US006374715B1

(12) United States Patent
Takatsuka

(10) Patent No.: US 6,374,715 B1
(45) Date of Patent: Apr. 23, 2002

(54) APPARATUS FOR PUNCHING SHEET

(75) Inventor: Hiroshi Takatsuka, Shimane-ken (JP)

(73) Assignees: Hitachi Metals, Ltd., Tokyo; HMY, Ltd., Shimane-Ken, both of (JP)

( * ) Notice: Subject to any disclaimer, the term of this patent is extended or adjusted under 35 U.S.C. 154(b) by 0 days.

(21) Appl. No.: 09/466,064

(22) Filed: Dec. 17, 1999

(30) Foreign Application Priority Data

Dec. 18, 1998 (JP) ..... 10-359906

(51) Int. Cl.[7] ..... B26D 5/16
(52) U.S. Cl. ..... 83/620; 83/628; 83/691
(58) Field of Search ..... 83/620, 628, 694, 83/684, 687, 691, 518, 624

(56) References Cited

U.S. PATENT DOCUMENTS 4,079,647 A * 3/1978 Elder et al. ..... 83/441.1
4,125,045 A * 11/1978 Jeremic ..... 83/618
4,257,300 A * 3/1981 Muzik ..... 83/620
4,532,843 A * 8/1985 Miyama ..... 83/618
4,823,661 A * 4/1989 Freres ..... 83/620
4,903,560 A * 2/1990 Half et al. ..... 83/624
5,253,030 A * 10/1993 Shigemura et al. ..... 83/628
5,588,344 A * 12/1996 Chun ..... 83/628
5,628,502 A * 5/1997 Amarakoon ..... 83/620
5,746,123 A * 5/1998 Eigenmann ..... 83/618
5,749,277 A * 5/1998 Walker ..... 83/624
5,778,750 A * 7/1998 Drzewiecki et al. ..... 83/628
5,852,765 A 12/1998 Yamashita et al.
6,065,379 A * 5/2000 Shinno et al. ..... 83/628

FOREIGN PATENT DOCUMENTS

JP 03228598 A 10/1991
JP 10249796 A 9/1998

* cited by examiner

*Primary Examiner*—Boyer Ashley
*Assistant Examiner*—Omar Flores-Sánchez
(74) *Attorney, Agent, or Firm*—Sughrue Mion, PLLC

(57) ABSTRACT

The apparatus for punching a sheet S includes a shaft 2 extending transversely relative to the moving direction of the sheet S; a pair of cams 3, 3 mounted to the shaft 2 in both longitudinal end portions for rotating together with the shaft 2; a tie bar 4 extending along the shaft 2 and having a pair of cam followers 41, 41 at positions corresponding to those of the cams 3, 3; a plurality of punches 5, 5 connected to the tie bar 4 in longitudinal arrangement for being movable to and from punching positions; a frame 7 extending along the tie bar 4, to which a plurality of punch guides 6, 6 are fixed in alignment with the punches 5, 5; and a die frame 8 having a plurality of die holes 81, 81 in alignment with the punches 5, 5 for cooperating with the punches 5, 5 to make holes in the sheet S.

8 Claims, 7 Drawing Sheets

APPARATUS FOR PUNCHING SHEET

FIELD OF THE INVENTION

The present invention relates to an apparatus for punching a sheet by cooperation of punches and dies.

DESCRIPTION OF PRIOR ART

When sheets such as copied papers are filed, they should be provided with holes through which they are filed. According to recent development of office machines, it is required that copied papers are automatically provided with holes for filing by punching machines mounted to the office machines, thereby eliminating troublesome manual work to punch copied papers.

Japanese Patent Laid-Open No. 3-228598 discloses an apparatus for punching a sheet to make filing holes, comprising (a) a cam assembly comprising a camshaft and a plurality of cams fixed to the cam shaft at predetermined intervals; (b) a punch assembly comprising an elongated support having a U-shaped cross section, a plurality of punches slidably supported by the U-shaped support, and springs each disposed around the punch between an inner surface of the U-shaped support and a stopper of the punch for biasing the punch inward the U-shaped support, and (c) a punch die having die holes each in alignment with each punch. This conventional sheet-punching apparatus comprises punches and cams in pairs, and therefore their numbers are the same.

When driving means such as cams and punches are used in the same number as in the above conventional punching apparatus, a large number of parts are necessary, requiring more time for assembling them. In addition, because a camshaft is subjected to a bending moment due to a reaction force at the time of punching, the camshaft should be thick in a large punching apparatus for papers of A3 or more size. A thicker camshaft leads to larger cams, resulting in increase in parts cost. Also, larger cams lead to larger height of the entire sheet-punching apparatuses, making it difficult to make the punching apparatuses smaller.

Office machines equipped with such sheet-punching apparatuses are conventionally limited to those highly expensive. However, recent demand for equipping relatively inexpensive office machines with such sheet-punching apparatuses requires drastic reduction of prices of such sheet-punching apparatuses, whereby development is strongly needed to provide less expensive sheet-punching apparatuses.

OBJECT AND SUMMARY OF THE INVENTION

Accordingly, an object of the present invention is to provide a high-performance, inexpensive apparatus for punching sheets such as copied papers.

In view of the above object, the inventors have found that using a combination of a driving system having a small number of cams and a tie bar having cam followers in slidable contact with the cams and connected to punches serves to reduce the number of driving parts such as cams, thereby making the assembling of a sheet-punching apparatus easier, and reducing a load applied to the driving system, which makes it possible to reduce the diameter of a camshaft of the driving system. With these features, it can be achieved to make a sheet-punching apparatus inexpensive. The present invention has been completed based on this finding.

Thus, the apparatus for punching a sheet according to the present invention comprises (a) a shaft extending transversely relative to the moving direction of the sheet; (b) a plurality of cams mounted to the shaft with a longitudinal interval for rotating together with the shaft; (c) a tie bar extending along the shaft and having a plurality of cam followers at positions corresponding to those of the cams; (d) a plurality of punches connected to the tie bar in longitudinal arrangement for being movable to and from punching positions; and (e) a die frame having a plurality of die holes in alignment with the punches for cooperating with the punches to make holes in the sheet.

The cams are preferably a pair of eccentric cams mounted to the tie bar in longitudinal end portions thereof. The eccentric cams may be arranged with a phase difference, whereby the tie bar moves toward and away from the punching positions with its longitudinal center axis inclined alternately, thereby providing the punches with different punching timing.

The tie bar is preferably constituted by a bent sheet having an increased cross section coefficient.

Each punch is preferably guided by a punch guide so that the punch can move substantially vertically though an inner wall of the punch guide even when the punch is subjected to inclining force by sliding contact of the cam followers with the eccentric cams.

Each punch preferably has a V-shaped, blade-forming notch diametrically extending on a tip end surface thereof, which is oriented along the moving direction of the sheet. Thus, a hole is made in a sheet without sudden drop of a shearing force to zero.

The apparatus for punching a sheet according to a preferred embodiment of the present invention comprises (a) a shaft extending transversely relative to the moving direction of the sheet; (b) a pair of cams mounted to the shaft in both longitudinal end portions for rotating together with the shaft; (c) a tie bar extending along the shaft and having a pair of cam followers at positions corresponding to those of the cams; (d) a plurality of punches connected to the tie bar in longitudinal arrangement for being movable to and from punching positions; (e) a frame extending along the tie bar, to which a plurality of punch guides are fixed in alignment with the punches; and (f) a die frame having a plurality of die holes in alignment with the punches for cooperating with the punches to make holes in the sheet.

DESCRIPTION OF PREFERRED EMBODIMENTS OF THE INVENTION

Figure 1:
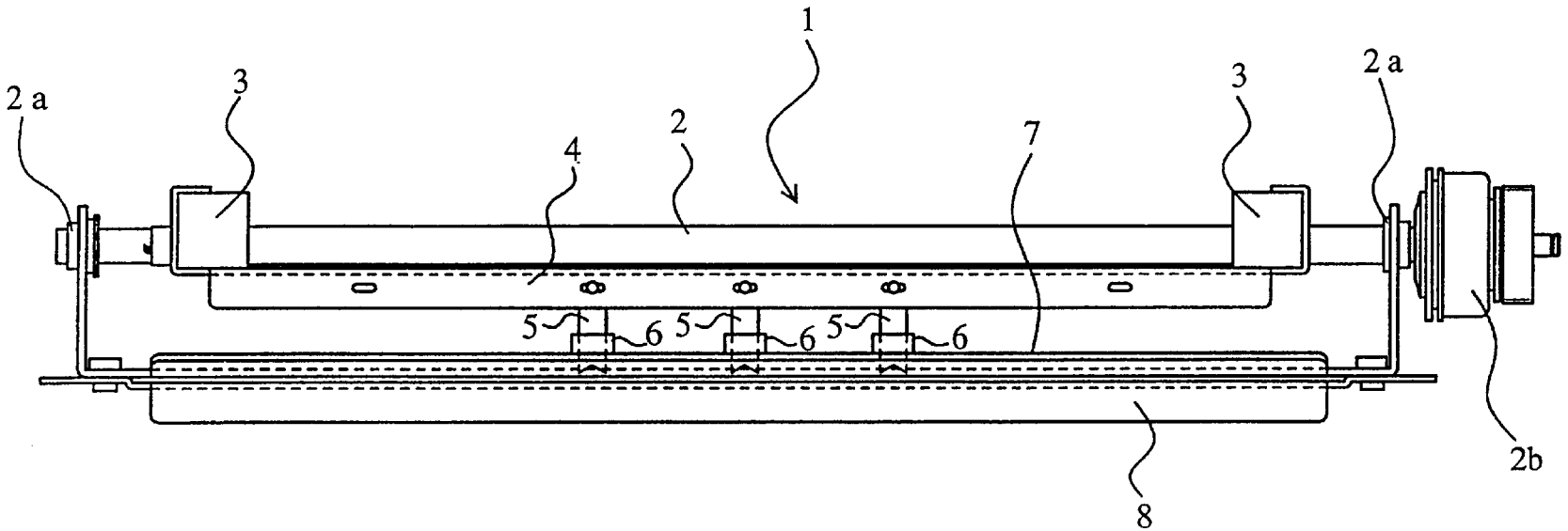
FIG. 1 is a front view showing a sheet-punching apparatus according to one embodiment of the present invention.
Figure 2:
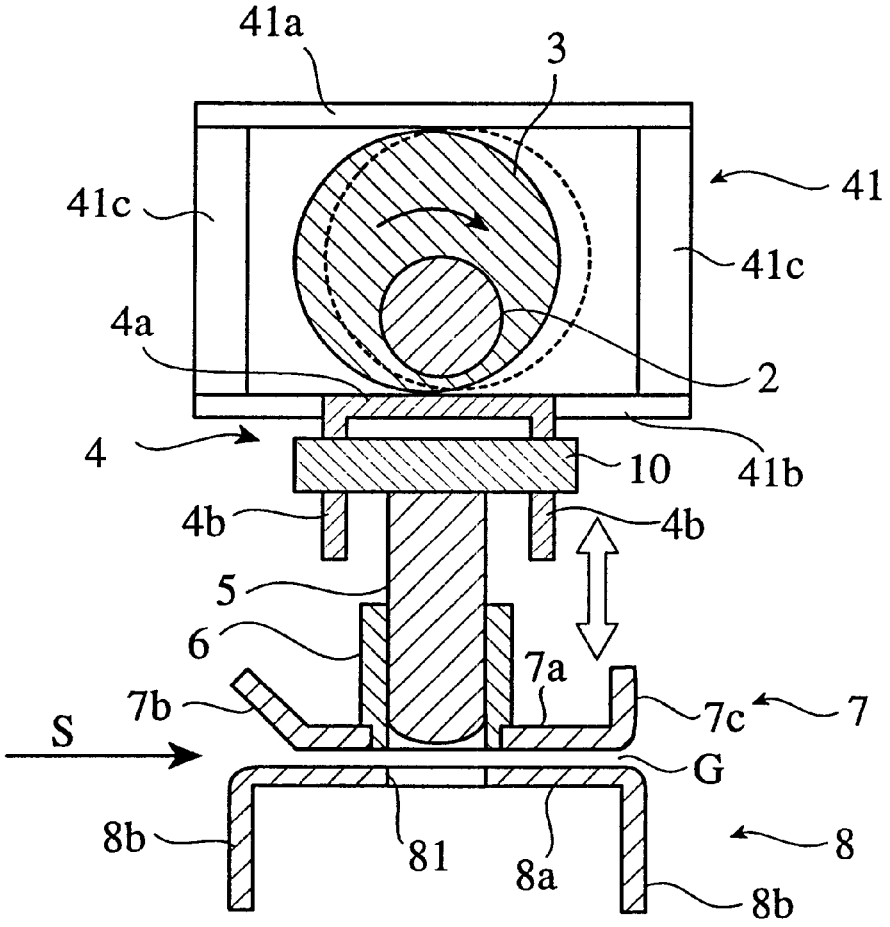
FIG. 2 is a cross-sectional end view of the apparatus shown in FIG. 1.
Figure 3:
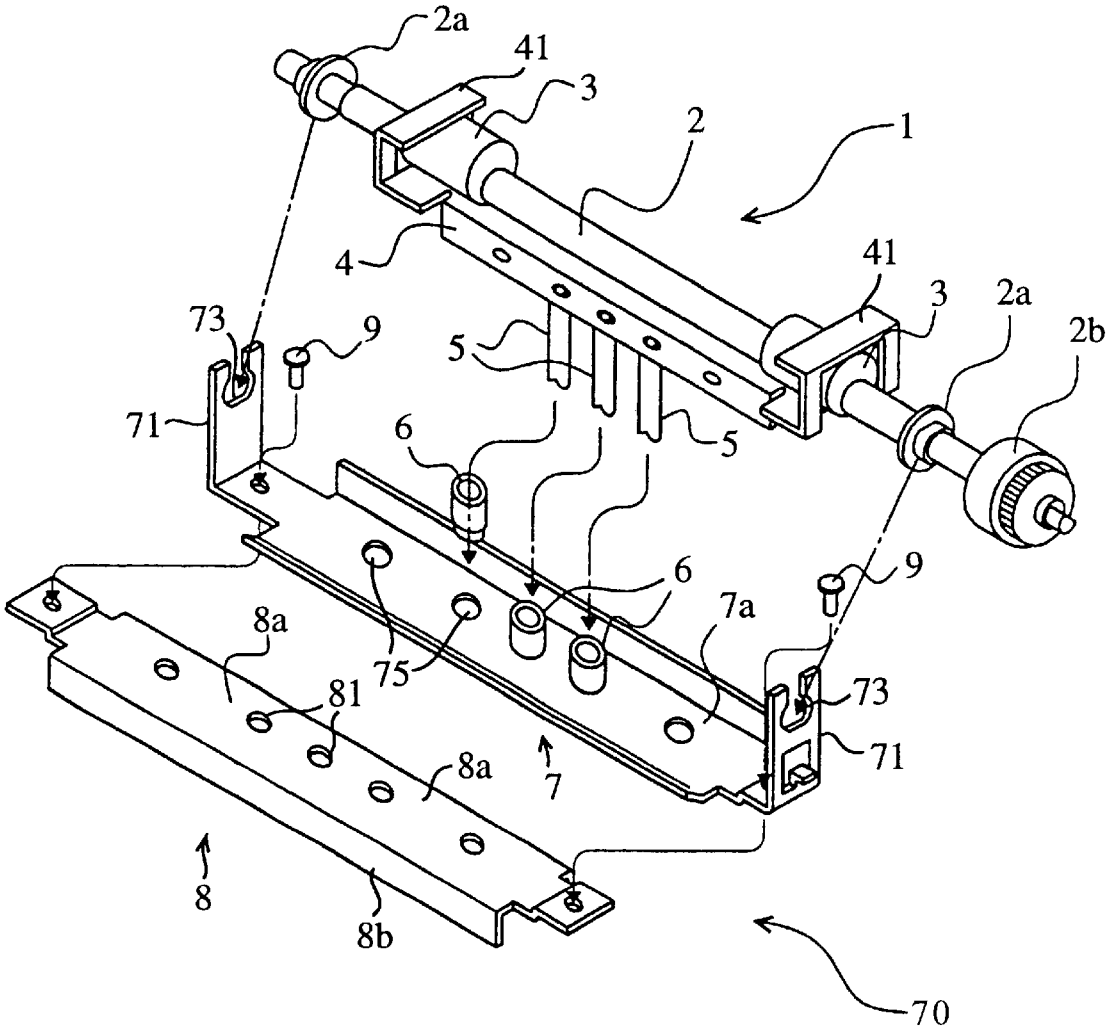
FIG. 3 is a schematic view showing the assembling of the sheet-punching apparatus of FIG. 1.

In a preferred embodiment of the present invention shown in FIGS. 1–3, a sheet-punching apparatus comprises a cam assembly 1, a tie bar assembly 40 and a frame assembly 70.

The cam assembly 1 is constituted by a camshaft 2, a pair of eccentric cams 3, 3 fixed to the camshaft 2 at predetermined positions, preferably near both ends, by pins, etc., a pair of bearings 2*a*, 2*a* mounted to both end portions of the camshaft 2, and a clutch 2*b* mounted to one end portion of the camshaft 2. In the preferred embodiment shown in FIGS. 1–3, both eccentric cams 3, 3 have the same eccentricity and are mounted to the camshaft 2 with a phase difference of 30°. Instead of the clutch 2*b*, a DC motor or a stepping motor may be fixed to a flange portion of the frame 7 to drive the camshaft 2 via a transmission means such as gears.

Figure 7:
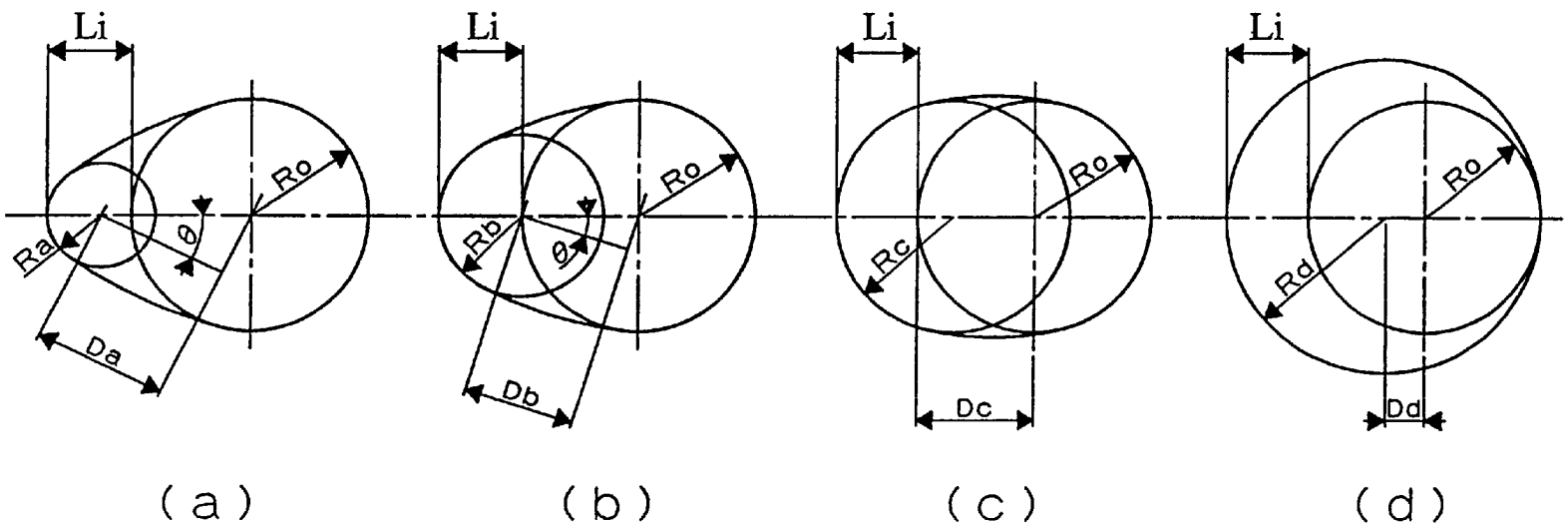
FIGS. 7(*a*)–(*d*) are schematic views showing four types of cams designed to have the same lift $L_i$ relative to a base circle having a radius of $R_0$.

Why an eccentric cam is preferable is clear from FIGS. 7(*a*)–(*d*) showing four types of cams having the same lift $L_i$ relative to a base circle having a radius of $R_0$. FIGS. 7(*a*)–(*c*) show projection cams, and FIG. 7(*d*) shows an eccentric cam. A moment generated when a cam is rotated to push a punch is proportional to the length $D_a$, $D_b$, $D_c$, or $D_d$ of a tangent connecting the base circle and a projection circle (radius: $R_a$, $R_b$, $R_c$, or $R_d$). Thus, the longer the tangent, the larger the moment applied to the punch, resulting in increased uneven wear in the punch and the punch guide. On the other hand, the eccentric cam shown in FIG. 7(*d*) has the shortest tangent (length: $D_d$), thereby providing a smaller moment to the punch even at the same lift $L_i$. Accordingly, the eccentric cam is effective to avoid uneven wear in the punch and the punch guide.

The tie bar assembly 40 comprises a tie bar 4 extending along the camshaft 2, which is integrally constituted by a longitudinal flat middle portion 4*a* and a pair of flange portions 4*b*, 4*b* vertically extending from both lateral sides of the flat middle portion 4*a*, and a pair of cam followers 41, 41 connected to both longitudinal ends of the flat middle portion 4*a*. The tie bar 4 having this structure can be formed from a flat metal sheet by cutting and bending. However, the cam followers 41, 41 may be formed by separate plastic parts fixed to the tie bar 4 by pressure fitting or adhesion. Both flange portions 4*b*, 4*b* have plural pairs of through-holes 42, 42, each pair of through-holes 42, 42 being positioned opposite each other relative to a center axis of the tie bar 4.

When the through-holes 42, 42 of the flange portions 4*b*, 4*b* are set different alternately by 0.5 mm in height, there is difference in gap between the edges of the punches 5, 5 and the edges of the die holes 81, 81 when they are at waiting positions, thereby providing different punching timing to make a load torque uniform. In this case, the cams 3, 3 on both sides of the camshaft 2 need not have phase difference.

Figure 4:
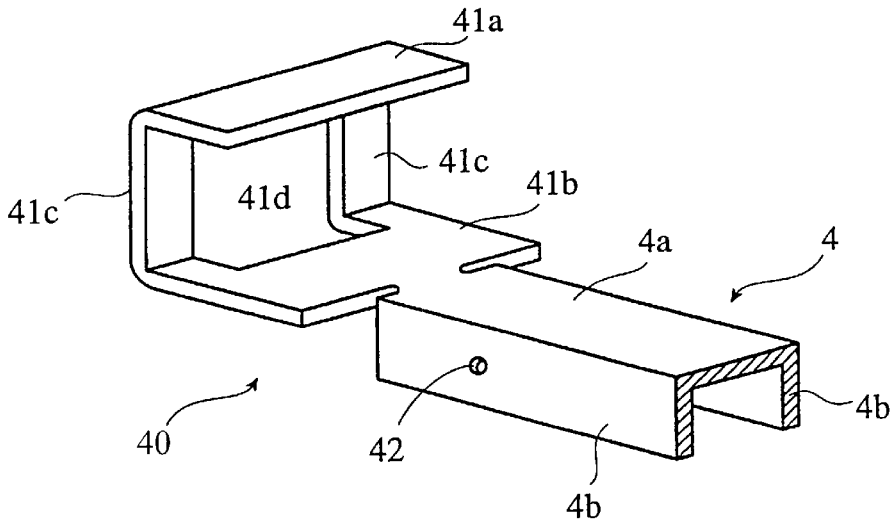
FIG. 4 is a perspective view showing a cam follower of a tie bar in the sheet-punching apparatus of FIG. 1.

As shown in FIGS. 2–4, each cam follower 41 has a rectangular U-shaped structure constituted by horizontal, upper and lower flat plates 41*a*, 41*b* and a pair of vertical web portions 41*c*, 41*c* each integrally connecting the upper and lower flat plates 41*a*, 41*b* with a window 41*d* through which the eccentric cam 3 penetrates. The distance between the upper and lower flat plates 41*a*, 41*b* is substantially the same as a diameter of the eccentric cam 3 with a clearance by which the eccentric cam 3 can slidably rotate in the upper and lower flat plates 41*a*, 41*b* of the cam follower 41. Both ends of a pin 10 are inserted into a pair of opposing through-holes 42, 42 of the vertical flange portions 4*b*, 4*b*, and an upper end of a punch 5 is connected to each pin 10. A rubber bush for suppressing noises may be disposed above the pins 10, 10 between the flange portions 4*b*, 4*b* and the punches 5, 5 in this embodiment.

The tie bar assembly 40 is assembled to the cam assembly 1 with the cams 3, 3 penetrating through the windows 41*d*, 41*d* of the cam followers 41, 41.

The frame assembly 70 is constituted by an elongated frame 7 and an elongated die frame 8. The elongated frame 7 is constituted by a longitudinally extending, flat middle portion 7*a*, and front and rear flange portions 7*b*, 7*c* integrally extending from both lateral sides of the flat middle portion 7*a*. The front and rear flange portions 7*b*, 7*c* are formed by bending both lateral side portions of an elongated flat sheet toward the same side at such angles that the frame 7 has a substantially U-shaped transverse cross section as shown in FIG. 2. Integrally connected to both ends of the flat middle portion 7*a* are upright portions 71, 71 each having a notch 73 having an upward opening.

The flat middle portion 7*a* of the frame 7 has a plurality of through-holes 75, 75 along a longitudinal center line, and tubular punch guides 6, 6 each having an annular step on an outer circular surface thereof are fixed into some of the through-holes 75, 75, by pressing or caulking a stepped portion of each punch guide 6 into each through-hole 75. The punch guides 6, 6 are preferably made of oil-impregnable sintered alloys, copper alloys or bearing alloys.

Attached to a lower surface of the flat middle portion 7*a* of the frame 7 with a gap through which a sheet S can pass is a die frame (die member) 8. The die frame 8 is preferably constituted by a flat middle portion 8*a* and a pair of vertical flange portions 8*b*, 8*b* integrally extending downward from lateral sides of the flat middle portion 8*a*. The die frame 8 having this structure can be formed from a flat metal sheet by cutting and bending.

The flat middle portion 8*a* of the die frame 8 has a plurality of through-holes 81, 81 in alignment with the through-holes 75, 75 of the frame 7. Instead of the through-holes 81, 81, proper die members each having a die hole may be fixed to the die frame 8. Both longitudinal end portions of the die frame 8 are fixed to both longitudinal end portions of the flat middle portion 7*a* of the frame 7 by threads 9, 9 or rivets.

Each punch 5 has a tip end surface having a substantially V-shaped blade-forming notch 5*a* extending diametrically, and the V-shaped notches 5*a*, 5*a* of the punches 5, 5 are oriented in the same direction as that of a sheet S moving through a gap G between the frame 7 and the die frame 8.

Figure 6A:
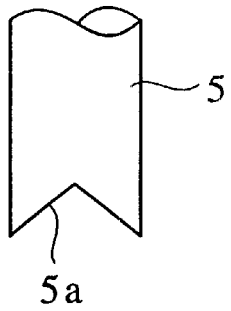
FIGS. 6(*a*)–(*c*) are side views showing examples of punches having various V-shaped notches.
Figure 6B:
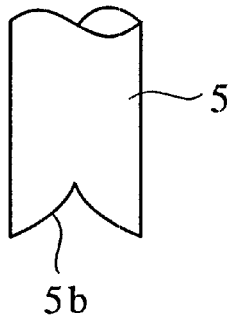
Figure 6C:
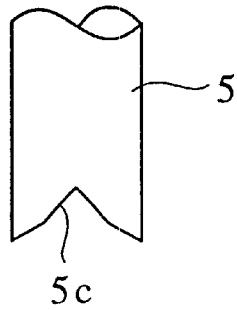

The V-shaped blade-forming notch is not restricted to a linearly cut notch 5*a* as shown in FIG. 6(*a*), but it may be in the form of a notch 5*b* having curved surfaces (FIG. 6(*b*)), or a notch 5*c* defined by bent flat surfaces (FIG. 6(*c*)).

The cam assembly 1 combined with the tie bar assembly 40 is mounted to the frame assembly 70, such that the bearings 2*a*, 2*a* of the camshaft 2 are inserted into notches 73, 73 of the upright flange portions 71, 71 of the frame 7 from above while inserting tip ends of the punches 5, 5 into the punch guides 6, 6.

As is clear from FIG. 1, the cams 3, 3, driving elements, are mounted in the least number of two, preferably in a pair, though 3 or more punch dies are used. Also, because the cams 3, 3 are disposed near the bearings 2*a*, 2*a*, there is only a small bending moment applied to the camshaft 2, whereby the camshaft 2 can be made thin.

When the camshaft 2 is rotated by one revolution by a driving means (not shown) via the clutch 2*b*, the tie bar 4 moves up and down with inclination changeable due to difference in height between the cam followers 41, 41 on both ends. Thus, the punches 5, 5 move up and down slidably along the punch guides 6, 6 successively from one to the next, thereby punching sheets (not shown) in cooperation with the stationary die 8. In this case, punched holes are provided successively from rightward or leftward along the frame 7. After each punch 5 moves to the lowest point (punching position), it returns to the highest point (waiting position).

The notch 5*a* of the punch 5 is preferably oriented along the moving direction of a sheet S. If otherwise, a tip end of the punch 5 would be abnormally worn, because the direction of a moment M applied to the punch 5 is likely out of alignment with the longitudinal direction of the punch 5. The lateral component of M is depicted as M' in FIGS. 8(*a*) and (*b*). For instance, when a cam 3 is rotated as shown in FIG. 2, a contact point between the cam 3 and the cam follower 41 of the tie bar 4 changes back and forth laterally, namely a point at which a force is applied to the tie bar 4 changes. This leads to the lateral inclination of the punch 5 connected to the tie bar 4 in FIG. 2.

Figure 8A:
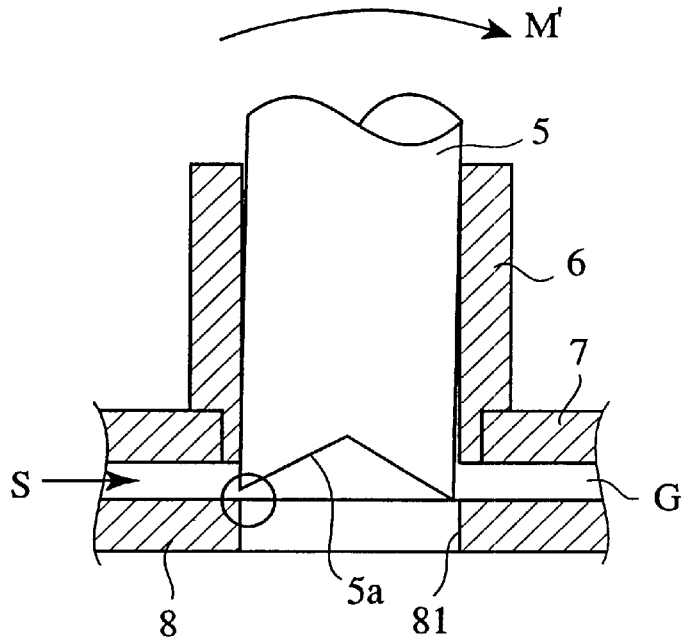
FIGS. 8(*a*) and (*b*) are cross-sectional views for explaining inclination occurring in a punch.
Figure 8B:
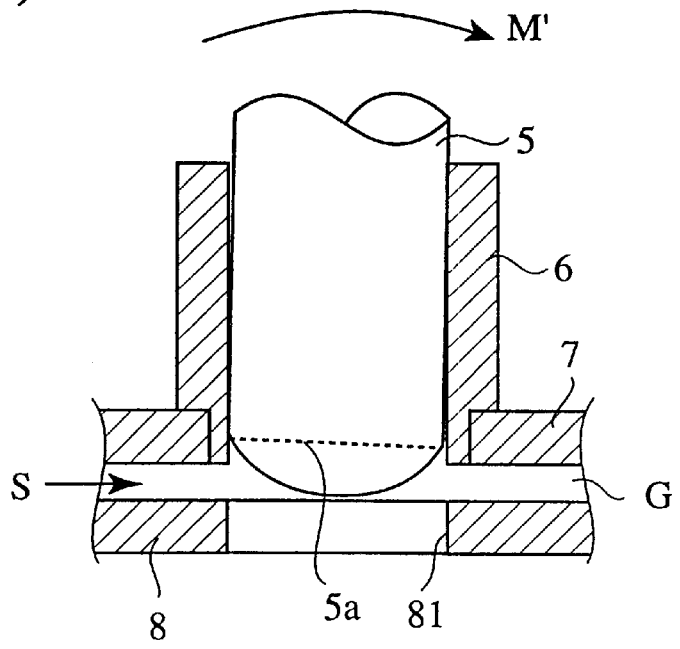

FIG. 8(*a*) indicates such undesirable orientation of the notch 5*a* of the punch 5. Specifically, if the notch 5*a* of the punch 5 is oriented in perpendicular to the moving direction of a sheet S, a lateral edge of the tip end of the punch 5 would come into contact with the edge of the die hole 81 of the die frame 8 when the punch 5 is inclined laterally by a moment applied to the punch 5. As a result, an edge portion of the punch 5 at its tip end is abnormally worn.

On the other hand, if the tip end of the punch 5 is provided with a V-shaped blade-forming notch 5*a* oriented in the direction of a sheet S moving in the sheet-punching apparatus, there would be no lateral edge in the tip end of the punch 5 coming into contact with the edge of the die hole 81 of the die frame 8 as shown in FIG. 8(*b*). Thus, the V-shaped notch 5*a* in a tip end surface of the punch 5 serves to suppress the variation of load applied to the punch 5. Also, because the punch 5 having a V-shaped blade-forming notch 5*a* at a tip end provides a small shearing force immediately before becoming zero, only small energy is freed when the sheet S is punched, resulting in excellent silence in the operation of the sheet-punching apparatus.

In the sheet-punching apparatus of the present invention in which punches 5, 5 move up and down along their center axes, it is preferable that a shearing force given by each punch 5 gradually increases to the maximum level and then decreases to zero. If the punch 5 has a tip end surface provided with a U-shaped notch, the shearing force would suddenly become zero after punching is finished. In this case, an energy stored in the driving system in the form of elastic deformation is suddenly freed, thereby being likely to cause noises by sudden movement or backlash of parts.

Figure 5:
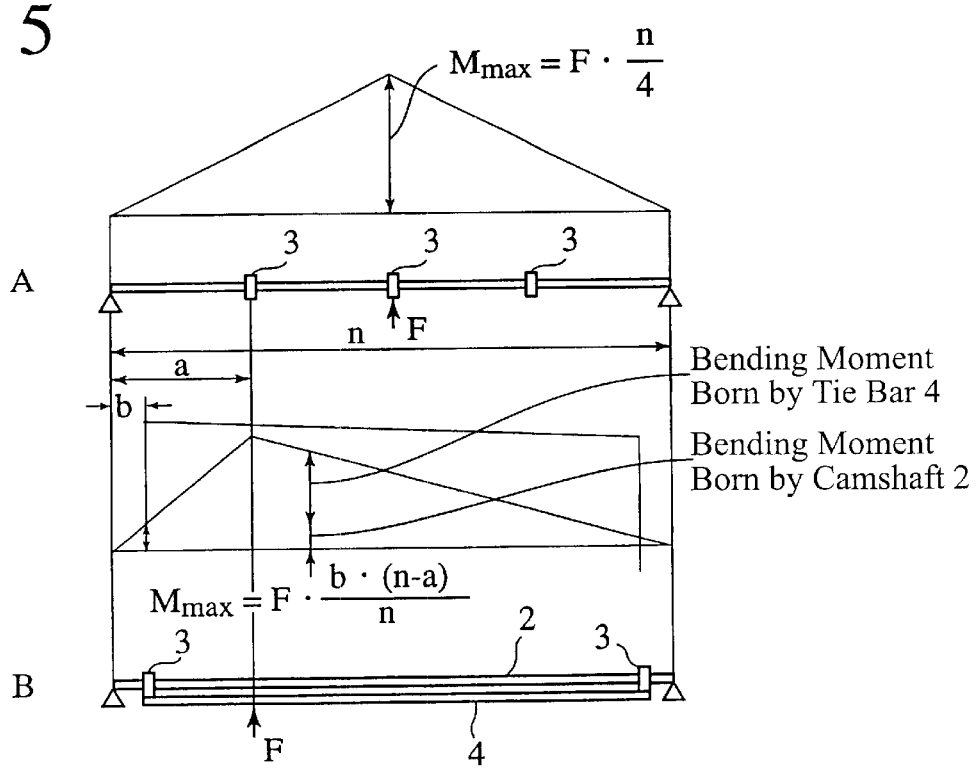
FIG. 5 is a schematic view for explaining a bending moment applied to a camshaft.

FIG. 5 is a diagram illustrating a punching reaction force F and a bending moment M applied to the camshaft 2 in both of the conventional system A and the system B of the present invention. For simplicity, it is assumed that a system is symmetric laterally for providing three holes to a sheet, and that the punching reaction force F is applied to the punch instantaneously. Each part of the system has a dimension as shown in FIG. 5. In the conventional system A, the maximum bending moment $M_{max}$ applied to the camshaft 2 at a center is expressed by $M_{max}=F\times n/4$, when punching is performed by a center punch.

On the other hand, in the system B of the present invention, the maximum bending moment $M_{max}$ applied to the camshaft 2 at a left cam is expressed by $M_{max}=F\times b\times(n-a)/n$, when punching is performed by the left cam. Because $(n-a)/n$ is smaller than 1, the maximum bending moment $M_{max}$ applied to the camshaft 2 can be made minimum by setting b less than n/4, thereby making the diameter of the camshaft 2 minimum. In this embodiment, the outer diameter of the camshaft 2 was reduced to 8 mm.

In the present invention, each punch 5 is preferably guided by a punch guide 6 to minimize the inclination of the punch 5 when moving up and down by the cam action, thereby keeping the punch 5 in concentric alignment with the die hole 81. This prevents the tip end edge of the punch 5 from being unevenly worn. In the preferred embodiment of the present invention, the timing of movement of a plurality of punches 5, 5 is changed successively to make even a load applied to the sheet-punching apparatus. Specifically, a plurality of punches 5, 5 are preferably arranged to provide different distance between the edges of punches 5, 5 and the edges of die holes 81, 81, to avoid simultaneous punching. This can be achieved by gradually increasing the length of the punches arranged along the tie bar from one disposed at one end to one disposed at the other end. Alternatively, when cams 3, 3 for moving the tie bar 4 are driven at different phase, the tie bar 4 moves up and down with its inclination changeable, thereby providing change in punching timing. The movement of tie bar-driving cams 3, 3 with a phase difference can minimize the stroke of the punches 5, 5 and also is advantageous in miniaturizing the sheet-punching apparatus because the outer diameter of the cam 3 can be made small.

In this embodiment, eccentric cams 3, 3 having the same eccentricity are disposed on both end portions of the camshaft 2, thereby simplifying the assembling of the sheet-punching apparatus, reducing the number of parts, and eliminating springs for returning the punches to the original positions. Also, the sheet-punching apparatus comprises slidable cam followers 41, 41 to simplify the structure the apparatus.

Though the conventional sheet-punching apparatus comprises driving elements in the same number as that of punches, the sheet-punching apparatus of the present invention comprises a tie bar to which a plurality of punches are mounted, thereby operable by only two cams disposed at both ends of a camshaft. Therefore, a large number of punched holes can be made without increasing the number of parts, resulting in extreme decrease in production cost while increasing easiness of assembling.

Also, in the conventional sheet-punching apparatus, a punching reaction force is directly transmitted to the camshaft at positions that are distant from the bearings of the camshaft, resulting in a large bending moment applied to the camshaft. Thus, the size reduction of the camshaft is limited because the camshaft should have enough mechanical strength and rigidity. On the other hand, the sheet-punching apparatus of the present invention can achieve the reduction of a bending moment applied to the camshaft by utilizing the tie bar having cam followers. The tie bar eliminates the necessity of aligning the cams to the punches. Instead, by disposing the cams near the bearings of the camshaft, a bending moment applied to the camshaft can be reduced, In addition, because the tie bar is formed by bending a metal sheet to have an L-shaped or U-shaped cross section having a high cross section coefficient, a bending moment is partially loaded to the tie bar, thereby making it possible to reduce the diameter of the driving shaft, resulting in the reduction of cost.

It should be noted that any modifications could be made to the sheet-punching apparatus of the present invention as long as they do not deviate from the scope of the present invention.

As described above, the sheet-punching apparatus of the present invention has a simple driving mechanism comprising a tie bar having cam followers as a means for conveying a force for driving the cams. Also, it has a camshaft having a reduced diameter due to decrease in a bending moment applied thereto.

What is claimed is:

1. An apparatus for punching a sheet comprising: (a) a shaft extending transversely relative to the moving direction of said sheet; (b) a plurality of cams mounted to said shaft for rotating together with said shaft; (c) a tie bar extending along said shaft and having a plurality of cam followers at positions corresponding to those of said cams; (d) a plurality of punches connected to said tie bar in longitudinal arrangement for being movable to and from punching positions; and (e) a die frame having a plurality of die holes in alignment with said punches for cooperating with said punches to make holes in said sheet, wherein said cams are a pair of eccentric cams mounted to said shaft at longitudinal end portions of said tie bar.

2. The apparatus for punching a sheet according to claim 1, wherein said eccentric cams are arranged with a phase difference, whereby said tie bar moves toward and away from said punching positions with its longitudinal center axis inclined alternately, thereby providing said punches with different punching timing.

3. The apparatus for punching a sheet according to claim 1, wherein said punches arranged along the tie bar have length gradually increasing from one disposed at one end to one disposed at the other end, whereby said punches work with different punching timing.

4. The apparatus for punching a sheet according to claim 1, wherein said tie bar is constituted by a bent sheet.

5. The apparatus for punching a sheet according to claim 1, wherein each punch is guided by a punch guide so that said punch can move substantially vertically though an inner wall of said punch guide even when said punch is subjected to inclining force by sliding contact of said cam followers with said eccentric cams.

6. The apparatus for punching a sheet according to claim 1, wherein each punch has a substantially V-shaped, blade-forming notch on a tip end surface, said V-shaped notch being oriented along the moving direction of said sheet.

7. The apparatus for punching a sheet according to claim 1, wherein said punches are arranged along the tie bar to be non-coincident with said plurality of cams.

8. An apparatus for punching a sheet comprising: (a) a shaft extending transversely relative to the moving direction of said sheet; (b) a pair of cams mounted to said shaft in both longitudinal end portions for rotating together with said shaft; (c) a tie bar extending along said shaft and having a pair of cam followers at positions corresponding to those of said cams; (d) a plurality of punches connected to said tie bar in longitudinal arrangement for being movable to and from punching positions; (e) a frame extending along said tie bar, to which a plurality of punch guides are fixed in alignment with said punches; and (i) a die frame having a plurality of die holes in alignment with said punches for cooperating with said punches to make holes in said sheet.

* * * * *